US008235230B2

(12) United States Patent
Juraszek

(10) Patent No.: US 8,235,230 B2
(45) Date of Patent: Aug. 7, 2012

(54) METHOD FOR CONTROLLING THE SLEWING MOVEMENT OF THE ROTARY PART OF A TOWER CRANE

(75) Inventor: Cedric Juraszek, Macon (FR)

(73) Assignee: Manitowoc Crane Group France (FR)

( * ) Notice: Subject to any disclaimer, the term of this patent is extended or adjusted under 35 U.S.C. 154(b) by 0 days.

(21) Appl. No.: 12/465,190

(22) Filed: May 13, 2009

(65) Prior Publication Data

US 2010/0006530 A1 Jan. 14, 2010

(30) Foreign Application Priority Data

May 22, 2008 (FR) ..... 08 02785

(51) Int. Cl.
*B66C 13/16* (2006.01)

(52) U.S. Cl. ..... 212/278

(58) Field of Classification Search ..... 212/276, 212/277, 278, 279, 280, 281
See application file for complete search history.

(56) References Cited

U.S. PATENT DOCUMENTS

| | | | | |
|---|---|---|---|---|
| 3,559,022 | A | 1/1971 | Tax | |
| 5,492,067 | A * | 2/1996 | Anderson | 105/163.2 |
| 6,631,300 | B1 * | 10/2003 | Nayfeh et al. | 700/55 |
| 6,634,514 | B2 * | 10/2003 | Ducrot | 212/285 |
| 7,515,389 | B2 * | 4/2009 | Kleine et al. | 361/51 |
| 7,599,762 | B2 * | 10/2009 | Discenzo et al. | 701/1 |
| 7,672,768 | B2 * | 3/2010 | Narisawa et al. | 701/50 |
| 2005/0017867 | A1 * | 1/2005 | Shaw et al. | 340/601 |

FOREIGN PATENT DOCUMENTS

| | | | |
|---|---|---|---|
| DE | 2340171 | | 2/1975 |
| DE | 26 18 388 | A * | 11/1977 |
| EP | 0 691 301 | A1 * | 1/1996 |
| EP | 1422188 | | 5/2004 |
| FR | 1191952 | | 10/1959 |
| FR | 1544012 | | 10/1968 |
| FR | 2907109 | | 4/2006 |

OTHER PUBLICATIONS

"The new 355 HC-L luffing jib crane" by Liebherr brochure, Printed Nov. 2005.*

French Search Report 0802785; Dated Jan. 16, 2009.

* cited by examiner

*Primary Examiner* — Emmanuel M Marcelo
(74) *Attorney, Agent, or Firm* — Cantor Colburn LLP

(57) ABSTRACT

A rotary part of a crane is associated with an electric slewing mechanism including at least one geared electric motor unit of which the electric motor is powered in such a way as to produce a slewing torque having a certain maximum value. When the crane is in use and for conditions such as windspeed greater than a given value, jib length greater than a given value and moment of the lifted load greater than a given value, the maximum value of a slewing torque produced by the electric motor is increased. The crane thus becomes easier to drive, particularly in the phases during which the jib is adopting a "windward trend".

5 Claims, 3 Drawing Sheets

METHOD FOR CONTROLLING THE SLEWING MOVEMENT OF THE ROTARY PART OF A TOWER CRANE

TECHNICAL FIELD OF THE INVENTION

The present invention relates to the technical field of tower cranes. More specifically, this invention relates to the motorized control of the slewing movement of the rotary upper part of a tower crane.

BRIEF DISCUSSION OF RELATED ART

A tower crane is usually made up of two main parts, these being, on the one hand, a non-rotating vertical pylon also known as the "mast" and, on the other hand, a rotary upper part, that is to say a part that can be slewed about a vertical axis of rotation. The rotary upper part, mounted at the top of the mast, is itself made up of a jib, which extends on one side of the vertical axis of rotation of this rotary part, and of a counterweighted counterjib, which extends on the other side of the vertical axis of rotation. The rotation of the rotary part about this vertical axis is controlled by a motorized unit, using electrical power, and hereinafter known by the expression "electric slewing mechanism".

In order for the rotary part to be mounted such that it can rotate at the top of the mast of a tower crane there is usually, between the jib and counterjib of the rotary part, a slewing ring made up of two concentric races, with a fixed race connected to the top of the mast and a mobile race secured to the rotary part, between which races balls or cylindrical rollers are mounted such that they can roll.

To control the rotation of the rotary part thus mounted, the electric slewing mechanism usually comprises a geared electric motor unit secured to this rotary part, which geared motor unit turns a vertical-axis pinion which meshes with a gear wheel cut into the fixed race of the slewing ring. Where a great deal of mechanical power has to be transmitted in order to set the rotary part in rotation, two or more geared motor units may be provided, each geared motor unit turning one pinion in mesh with one and the same gear wheel.

By way of examples of such slewing mechanisms, reference is made to patent documents EP 1 422 188 and FR 2 907 109.

When the tower crane is "not in use", that is to say outside of the periods of operation of the crane, the crane is usually set to "weathervane": the rotary part is no longer braked in terms of rotation, or is so only to a reduced extent, which means that it can slew freely at any time, according to the wind direction. The jib therefore slews downwind, while the counterjib positions itself upwind, because the area of the jib exposed to the wind is very much higher than that of the counterjib.

During periods in which the tower crane is in operation, it is subjected to fatigue cycles as a result in particular of the alternating rotations of the rotary part in one direction, under load, and "unladen" return journeys made by this rotary part. The mast of the crane is therefore subjected to torque loadings which need to be limited to a maximum torque value that this mast can withstand.

To this end, the electric slewing mechanism of the crane is controlled by a computer which limits the value of the slewing toque to the maximum torque value that has been predefined.

It should also be noted that, during crane operating periods, the rotary part of this crane and, in particular, the jib, presents significant windage, particularly when set into motion, it being possible for the effect of the wind to result in additional resistive torque.

The torque limit imposed by the computer, combined with the resistive torque due to the wind, makes it potentially difficult for the crane driver to control the rotation and positioning of the jib, particularly the movement of the jib under load, in the presence of a wind particularly if the windspeed is above a certain threshold value.

Patent FR 1 544 012 describes a control of the slewing movement of a tower crane (without a counterjib) in which, in order to overcome a resistive torque due to a strong wind, provision is made for the actuation of an auxiliary geared motor unit, which acts on the gear wheel of the slewing mechanism, in addition to the main geared motor unit. The addition of a second geared motor unit, for occasional use, adds complexity and cost.

BRIEF SUMMARY OF THE INVENTION

The present invention aims to avoid these disadvantages and intends to make a tower crane easier to drive, in terms of improving the control of the slewing movement of the rotary part of the crane in the presence of wind, and to do so in a way that is simple and, in particular, does not involve adding an auxiliary geared motor unit.

To this end, the subject of the invention is, essentially, a method for the motorized control of the slewing movement of the rotary upper part of a tower crane, the rotary part being made up of a jib and of a counterjib and this rotary part being associated with an electric slewing mechanism comprising at least one geared electric motor unit with an electric motor and reduction gearbox, of which the electric motor is electrically powered in such a way as to produce a slewing torque transmitted to the rotary part of the crane, this torque having a maximum value, this method being characterized in that, when the crane is in use and for conditions comprising at least one windspeed greater than a given value, the maximum value of the slewing torque that can be produced by the aforementioned electric motor is increased as long as those conditions prevail.

Advantageously, the maximum value of the slewing torque is increased in the event of a windspeed greater than a given value and for at least one additional condition consisting of the fact that the length of the jib of the crane is greater than a given value and/or that the moment of the load suspended from the jib is greater than a given value or than a given fraction of the maximum permissible moment.

If these conditions are met, then the method of the invention in particular makes the provision that the slewing torque may be increased, within the limits of the increased maximum value thus authorized, as a function of the angular position of the jib and of the wind direction, particularly so as to increase the driving torque of the geared motor unit in phases during which the jib is adopting a "windward trend".

By way of an example of one implementation of the method of the invention, the conditions that all have to be present in order for the maximum value of the slewing torque to be increased may be:

- a windspeed in excess of 50 km/hour,
- a jib length in excess of 40 meters,
- a moment of the load in excess of 80% of the maximum permissible moment of the load.

It is specified that, here, "moment of the load" means the product of the weight of the load lifted by the crane, times the span which is the horizontal distance between this load and the mast of the crane (or the axis of rotation of the rotary part).

The various parameters taken into consideration in the method of the invention are provided by appropriate sensors and/or by calculation. In particular, as far as the moment of the load is concerned, this can be obtained by calculation, from the weight of the load as given by a strain gauge-based proving ring, and from the span measured by a potentiometer located on the winch used to move the trolley along the jib. It is also possible to use a moment sensor which directly provides the moment of the load by measuring the displacement of torsion bars.

By virtue of the method of the invention, the maximum value of the torque that can be supplied by the motor of the electric slewing mechanism is increased for example by 15% when the conditions defined hereinabove are simultaneously present. The mechanism then becomes capable of delivering greater torque, provided that the crane driver demands a speed setpoint that is such that this higher torque must be attained. No auxiliary geared motor unit is required.

However, it is necessary to avoid continuous use of such an increased torque value, because of the problems, explained hereinabove, associated with fatigue of the mast structure. Inappropriate use such as this could, for example, result from the user disconnecting the connection between one output from a computer processing the information from the sensors in order to give the authorization to increase the torque, on the one hand, and one input to an actuator such as a frequency variator which controls the electric motor of the electric slewing mechanism, on the other hand. Accordingly, the method of the invention advantageously further comprises a comparison between the status of the input to the actuator, such as a frequency variator, and the command given by the computer, and in the event that the status of this input does not correspond to the command given by the computer, there is an automatic switching of the electric slewing mechanism into downgraded mode, for example by reducing its speed.

Another subject of the invention is a device for implementing the method defined hereinabove, in a device for the motorized control of the slewing movement of the rotary upper part of a tower crane, this device comprising, in the generally known way, an electric slewing mechanism comprising at least one geared electric motor unit with an electric motor and reduction gearbox, of which the electric motor is electrically powered in such a way as to produce a slewing torque transmitted to the rotary part of the crane, this torque having a maximum value, an actuator such as a frequency variator being provided for controlling the motor of the electric slewing mechanism, this device being characterized in that it comprises a computer provided with inputs that allow it to determine the windspeed and other parameters such as the length of the jib of the crane and the moment of the load suspended from the jib, and with an output which is connected to one input of the actuator, such as a frequency variator, and which is able to deliver to this actuator, as a function of the parameters processed, a command authorizing an increase in the maximum value of the slewing torque.

By virtue of these specific arrangements, the device of the invention makes it possible, for brief periods, to increase the torque of the motor of the electric slewing mechanism, driven by the frequency variator, in order to make the crane easier to drive when a wind of a certain strength is present.

BRIEF DESCRIPTION OF THE SEVERAL DRAWINGS

The invention will be better understood from the description which follows, with reference to the attached schematic drawing which, by way of example, depicts one embodiment of this device for controlling the slewing movement of the rotary part of a tower crane:

DETAILED DESCRIPTION OF THE INVENTION

Figures 1, 2:
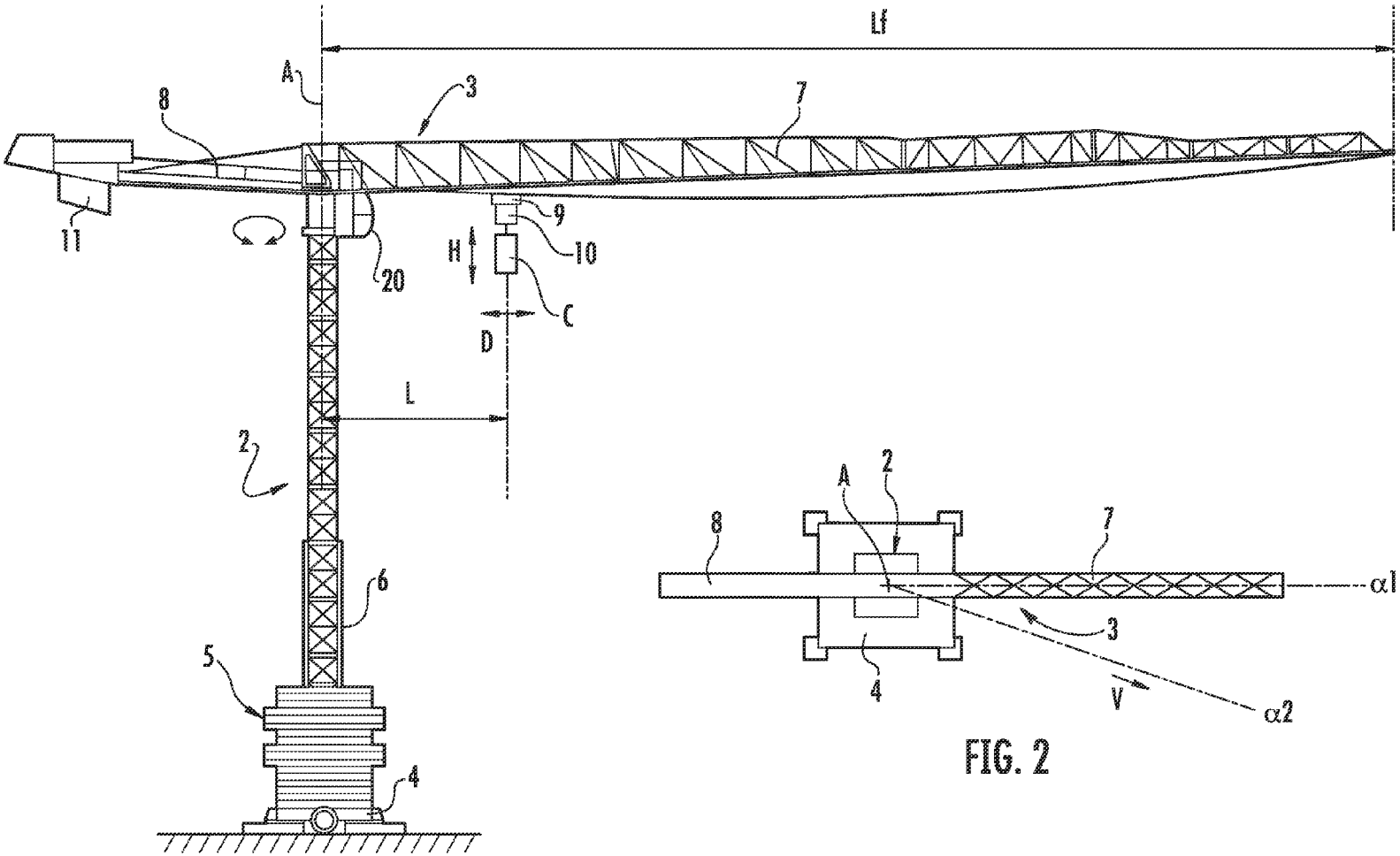
FIG. 1 is an overall side view of a tower crane which may be fitted with the control device according to the present invention.
FIG. 2 is a plan view of the tower crane of FIG. 1, from above.

With reference to FIGS. 1 and 2, a tower crane comprises, in general, a mast 2 and a rotary part 3 which is mounted at the top of the mast 2. In the example illustrated, the mast 2 rises up above a fixed pedestal 4, which also carries base ballast 5. This mast 2 consists of an assembly of a certain number of superposed mast sections and comprises a telescopic cage 6 allowing the mast to be raised by adding further mast sections.

The rotary part 3 of the crane is made up of a jib 7 directed "forwards" and of a counterjib 8 aligned with the jib 7 but directed in the opposite direction, that is to say "backwards", it being possible for this rotary part 3 to be slewed about a vertical axis A which coincides with the central axis of the mast 2. The jib 7 acts as a runway for a jib trolley 9, under which there hangs a lifting hook 10 to which a load C can be hooked. Thus, the load C can be moved in a horizontal movement known as "trolleying" (arrow D) and also in a vertical lifting movement (arrow H). The counterjib 8 is equipped, at the rear, with a counterweight 11 which at least partially balances the weight of the jib 7 and of the load C lifted by the hook 10.

Figure 3:
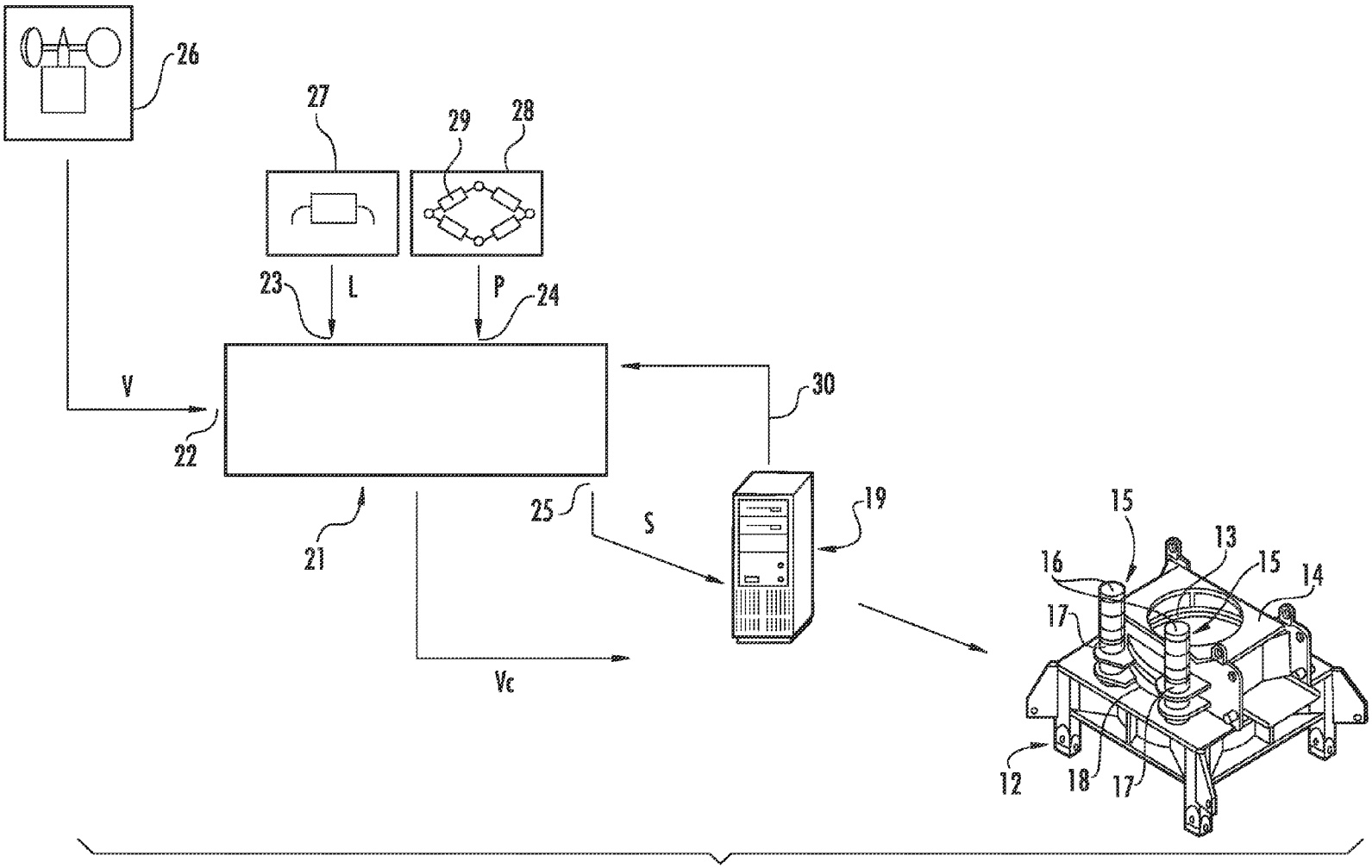
FIG. 3 is a block diagram of the control device according to the invention, illustrating the electric slewing mechanism in a particular embodiment.

Referring also to FIG. 3 (bottom right), an electric slewing mechanism 12 is positioned between the rotary part 3 and the top of the mast 2, this mechanism 12 also being sited between the jib 7 and the counterjib 8. The slewing mechanism 12 comprises a fixed slewing ring 13, borne by the top of the mast 2, and a rotary pivot 14 secured to the rotary part 3. In the example illustrated, this mechanism 12 further comprises two similar geared motor units 15 borne by the rotary pivot 14, each geared motor unit 15 being made up of an electric motor 16 and of a reduction gearbox 17. The output shaft of each reduction gearbox 17 carries a vertical-axis pinion which meshes with a gearwheel 18 cut into the slewing ring 13. The two geared motor units 15, or more specifically the electric motors 16 thereof, are controlled by a frequency variator 19. The latter is itself controlled by the crane driver, stationed in the driving cab 20 of the crane, particularly to receive stop and start and direction of rotation commands, as well as a speed setpoint.

According to the invention, and as shown by FIG. 3, there is added to the frequency variator 19 a computer 21 that has specific functions, and comprises various inputs 22, 23, 24 and an output 25 which is connected to one input of the frequency variator 19.

A first input 22 of the computer 21 is connected to an anemometer 26 carried by the crane, and which thus supplies the computer 21 with a signal V representative of the windspeed in the immediate surroundings of the crane.

A second input 23 of the computer 21 is connected to a sensor 27 which indicates the span L, that is to say the horizontal distance between the jib trolley 9, and therefore the load C, on the one hand, and the vertical axis A, on the other hand.

A third input 24 of the computer 21 is connected to a proving ring 28 of the strain gauge 29 type, positioned on a pulley supporting the lifting cable, and which supplies a signal representing the weight P of the load C suspended from the lifting hook 10.

Hence, the computer 21 determines the instantaneous windspeed and at the same time calculates the moment of the load, as the product of the span L and of the weight P of the load C, in other words by multiplying the signal L received at the second input 23 by the signal P received at the third input 24.

The computer 21 also "knows" the parameter that is the total length Lf of the jib 7 on which the wind the speed of which has been measured acts.

Figure 4:
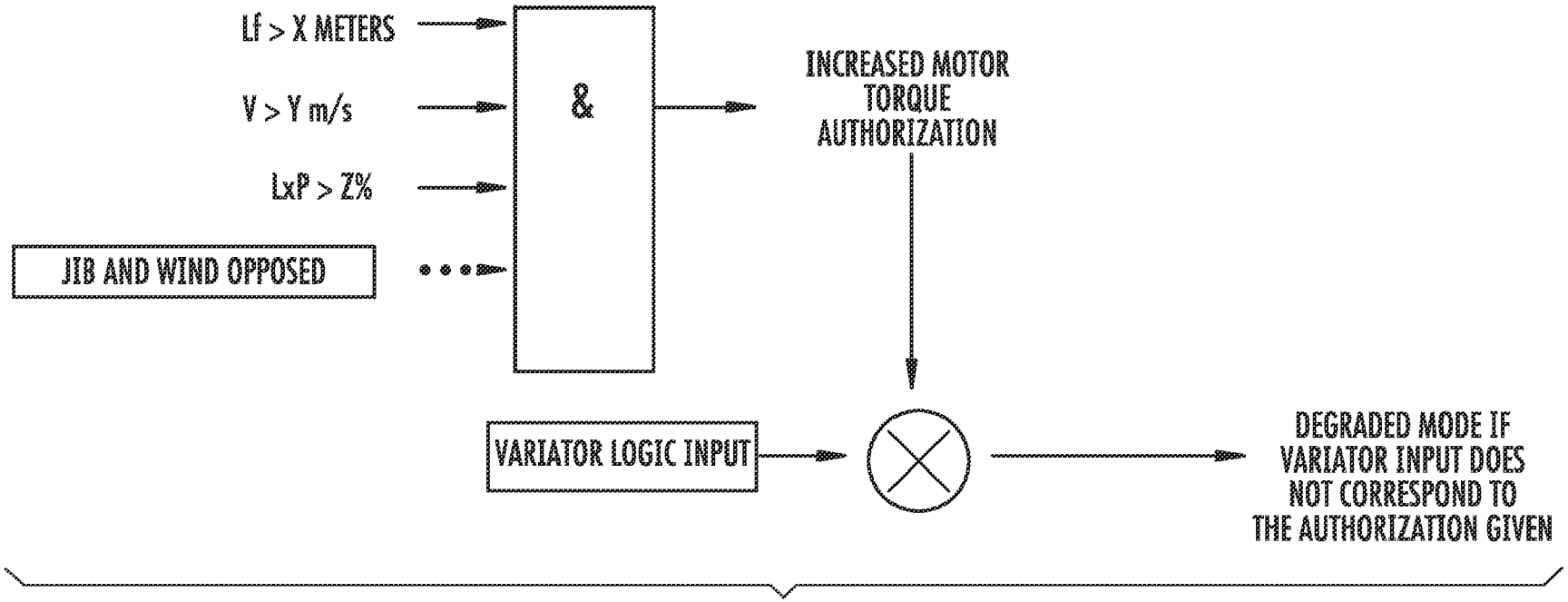
FIG. 4 is another explanatory diagram illustrating the operating "logic" of the control device according to the invention, particularly in its function of authorizing an increased maximum value for the slewing torque.

The computer 21 can thus perform a logic operation illustrated symbolically in FIG. 4, which consists in checking that all of the following three conditions are simultaneously present:

jib length Lf>x meters windspeed V>Y m/second moment of the load P×L>Z % of the maximum permissible value.

If all of these three conditions are met at the same time then the output 25 of the computer 21 delivers a signal S authorizing operation at an increased maximum slewing torque, for example at a torque increased by 15% over the usual maximum value. This authorization signal S is carried to one input of the frequency variator 19 which controls the respective electric motors 16 of the geared motor units 15.

To control the geared motor units 15, the computer 21 can also take two further parameters into consideration, these being the instantaneous angular position (angle "alpha 1") of the jib 7, and the wind direction (angle "alpha 2"). The angular position "alpha 1" of the jib 7 may be provided by a slewing sensor associated with the electric slewing mechanism 12, such as the sensor described in the aforementioned patent document FR 2 907 109. The wind direction "alpha 2" is indicated by a specific sensor of the "weathervane" kind installed on the crane.

The computer 21 is thus able, by comparing the angular orientation "alpha 1" of the jib 7 with the direction of the wind "alpha 2", to determine whether a commanded rotation of the jib 7 corresponds to a windward trend requiring a higher motor torque. If the authorization to increase the maximum value of the slewing torque is present (i.e. if all of the aforementioned conditions are simultaneously met), then a command in the form of the signal S is emitted and the motor torque can thus actually be increased in phases in which the jib has a windward trend. This control is coupled with regulating the speed and, in particular, the speed setpoint imposed by the crane driver.

In addition, in order to avoid continuous use of a torque value increased in this way, the status of the input to the frequency variator 19 is constantly monitored, by a feedback connection 30, to ensure that this input has not been disconnected by the user. If the status of this input does not correspond to the command S given at the output 25 from the computer 21, then the electric slewing mechanism 12 is automatically switched by the computer 21 into a downgraded mode. In particular, the computer 21 then sends a special speed setpoint $V_c$ to another input of the frequency variator 19 to impose a reduction in speed for the movement of slewing the rotary part 3 of the crane.

The following would not constitute departures from the scope of the invention as defined in the attached claims:

taking into consideration more or fewer and miscellaneous parameters when authorizing the temporary increase in the maximum value of slewing torque;

altering the number of geared motor units in the electric slewing mechanism, it being possible in particular for the geared motor unit to be a single unit if its power is great enough to turn the rotary part;

replacing the specific computer with corresponding functions incorporated into a processing unit that also performs other crane control and monitoring functions;

replacing the frequency variator by any analogous "actuator" designed to control one or more electric motors;

using any appropriate type of sensor for directly or indirectly measuring the magnitudes of the parameters involved in the method, for example for determining the moment of the load.

The invention claimed is:

1. Method for motorized control of a slewing movement of a rotary upper part of a tower crane, the rotary part comprising a jib and a counterjib, the rotary part being associated with an electric slewing mechanism comprising at least one geared electric motor unit with an electric motor and reduction gearbox, the method comprising:

powering the electric motor electrically in such a way as to produce a slewing torque transmitted to the rotary part of the crane, the slewing torque having a first torque value corresponding to a first period of use and a second torque value corresponding to a second period of use, wherein the first torque value is a maximum amount of the slewing torque transmitted to the rotary part of the crane during the first period;

wherein the second torque value is a maximum amount of the slewing torque transmitted to the rotary part of the crane during the second period;

wherein the first period of use is a time period in which a windspeed is less than or equal to a given value;

wherein the second period of use is a time period in which a windspeed is greater than the given value, and wherein the second torque value is greater than the first torque value.

2. Control method according to claim 1, wherein said second period of use further comprises a condition in which a length of the jib of the crane is greater than a given length value, and/or a moment of a load suspended from the jib is greater than a given moment value or greater than a given fraction of a maximum permissible moment.

3. Control method according to claim 1, wherein the slewing torque is increased, within limits of the second torque value, as a function of an angular position of the jib and of a wind direction, so as to increase driving torque of the geared motor unit in phases during which the jib is adopting a windward trend.

4. Control method according to claim 1, further comprising:

comparing a status of an input to an actuator comprising a frequency variator, which controls the electric motor of the electric slewing mechanism, and a command given by a computer processing information from sensors in order to give authorization to increase the torque, and switching of the electric slewing mechanism automatically into a downgraded mode comprising a reducing of speed, in the event that the status of the input does not correspond to the command given by the computer.

5. Device for motorized control of a slewing movement of a rotary upper part of a tower crane, the device comprising:

an electric slewing mechanism comprising at least one geared electric motor unit with an electric motor and reduction gearbox, the electric motor being electrically powered in such a way as to produce a slewing torque transmitted to the rotary part of the crane, this torque having a first torque value, an actuator comprising a frequency variator provided for controlling the motor of the electric slewing mechanism, a computer provided with inputs that allow the computer to determine windspeed and other parameters including a length of a jib of the crane and a moment of a load suspended from the jib, and with an output which is connected to one input of an actuator comprising a frequency variator, and which is able to deliver to the actuator, as a function of parameters processed, a command authorizing a second torque value of the slewing torque, wherein the second torque value is greater that the first torque value;

wherein the first torque value is a maximum amount of the slewing torque transmitted to the rotary part of the crane during a first period of use of the crane; and wherein the second torque value is a maximum amount of the slewing torque transmitted to the rotary part of the crane during a second period of use of the crane.

* * * * *